United States Patent [19]

Minami et al.

[11] 4,422,295

[45] Dec. 27, 1983

[54] LUBRICATING SYSTEM FOR TURBO-CHARGERS

[75] Inventors: Shunji Minami, Fukuroi; Hiroshi Kimura, Iwata, both of Japan

[73] Assignee: Yamaha Motor Co., Ltd., Japan

[21] Appl. No.: 307,645

[22] Filed: Oct. 1, 1981

[30] Foreign Application Priority Data

Oct. 31, 1980 [JP] Japan ..... 55-153479

[51] Int. Cl.[3] ..... F01M 1/08

[52] U.S. Cl. ..... 60/605; 184/6.11; 184/6.16

[58] Field of Search ..... 60/605; 123/196 S; 184/6.11, 6.16

[56] References Cited

U.S. PATENT DOCUMENTS

| | | | |
|---|---|---|---|
| 4,199,950 | 4/1980 | Hakanson et al. | 60/605 |
| 4,256,069 | 3/1981 | Masuda et al. | 123/196 S |

FOREIGN PATENT DOCUMENTS

| | | | |
|---|---|---|---|
| 942234 | 4/1956 | Fed. Rep. of Germany | 60/605 |
| 53-143822 | 12/1978 | Japan | 60/605 |
| 567490 | 2/1945 | United Kingdom | 184/6.16 |

*Primary Examiner*—Michael Koczo
*Assistant Examiner*—Peggy A. Loiacano
*Attorney, Agent, or Firm*—Ernest A. Beutler

[57] ABSTRACT

A lubricating system for turbo-charger wherein the turbo-charger bearings are located at or below the normal level of oil in the lubricating sump for return of oil from the sump to the turbo-charger bearings when the engine is not running so as to insure cooling of the bearings when the engine is not running.

8 Claims, 3 Drawing Figures

LUBRICATING SYSTEM FOR TURBO-CHARGERS

BACKGROUND OF THE INVENTION

This invention relates to a lubricating system for turbo-chargers and more particularly to an improved lubricating system that insures against damage to the drive bearings of a supercharger upon stopping and subsequent restarting of the associated engine.

The use of superchargers as a device for inreasing the power output of an engine is well known. These devices, particularly those of the centrifugal type, rotate at extremely high speeds. In many applications it is not uncommon for the impeller and its driving shaft to rotate at speeds of in excess of 100,000 rpm. With such high rotational speeds it is important that the supporting bearings of the impeller and its drive shaft receive adequate lubrication and, for this reason, it has been the general practice to provide pressure lubrication for the bearings.

When the supercharger is of the turbo-charged type (the compressor is driven by an exhaust gas driven turbine) still additional problems are encountered. The turbine stage of a turbo-charger operates at relatively high temperatures. When the engine stops running, the residual heat in the turbo-charger acts upon the lubricant remaining on the bearing surfaces and can cause thermal deterioration of the lubricant. In fact the heat may be sufficient so as to cause the lubricant to carbonize on the bearings. Thus, upon subsequent restarting of the engine there can be significant damage to the bearings due to improper lubrication and the retention of the carbonized material in the bearing surfaces. In order to prevent these difficulties, it has been proposed to embody an arrangement wherein even though the engine is switched off, it is operated under a idle mode for a period of time so as to permit cooling of the bearings. Alternatively, it has been proposed to control the engine on restarting so that it will not be driven faster than its idle speed for a certain period of time to insure removal of the thermally degraded oil and other deposits before the engine can be operated at high speeds. Of course, such arrangements are not only expensive but are objectionable to the operator.

It is, therefore, a principal object of this invention to provide an improved lubricating system for an engine supercharger.

It is another object of this invention to provide an improved turbo-charger lubricating system.

It is yet a further object of this invention to provide a lubricating system for a supercharger wherein the bearings are supplied with oil after the engine is stopped.

SUMMARY OF THE INVENTION

This invention is adapted to be embodied in a lubricating system having a supercharger of an internal combustion engine which supercharger includes a drive shaft that is supported by bearing means. A lubricating system is incorporated for delivering oil to the bearing means when the engine is running. In accordance with the invention, means are provided for delivering oil to the bearing means when the engine is stopped.

DETAILED DESCRIPTION OF THE PREFERRED EMBODIMENT

Figure 1:
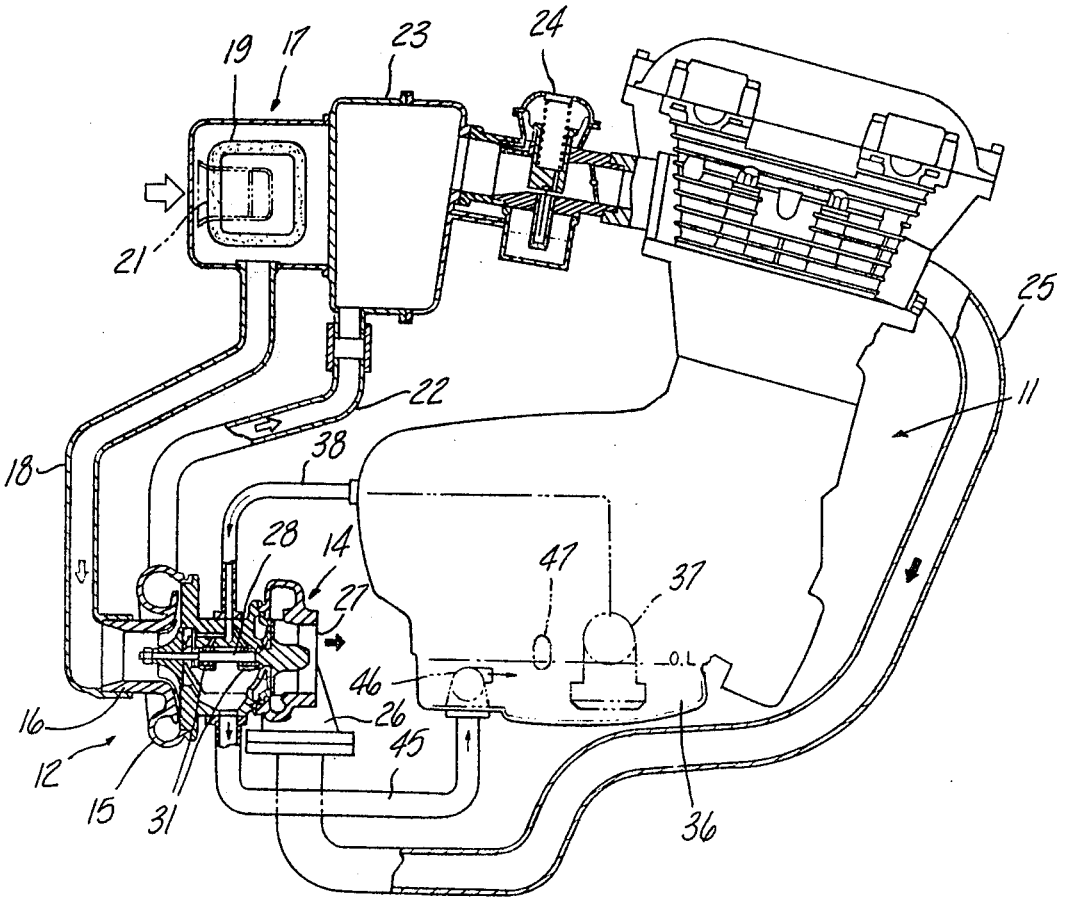
FIG. 1 is a side elevational view, with portions shown in cross section, of a supercharged internal combustion engine constructed in accordance with an embodiment of the invention.

A turbo-charged internal combustion engine constructed in accordance with an embodiment of this invention is identified generally by the reference numeral 11. The engine 11 may be of any known type and is depicted as being of a multi-cylinder, in line configuration. A turbo-charger, indicated generally by the reference numeral 12, is provided for delivering a compressed air charge to the engine induction system. The turbo-charger 12 is shown in enlarged, cross-section view in FIG. 2 and consists of a main housing assembly having a central body 13 positioned between an exhaust driven turbine section 14 and a compressor section 15. The compressor section 15 has an inlet 16 that receives filtered air from an air cleaner 17 via an intake pipe 18. A filter element 19 is disposed in the air cleaner 17 between an inlet opening 21 and the discharge to the intake pipe 18. The air compressed by the compressor stage 15 is discharged through a compressed air outlet pipe 22 for delivery to a plenum chamber 23. The plenum chamber 23 serves one or more carburetors 24 which, in turn, discharge into the intake ports of the engine 11. Thus, a pressurized charge is delivered by the compressor stage 15, plenum chamber 23 and carburetors 24 to the engine.

The turbine stage 14 is driven by exhaust gases which are discharged from the engine 11 through exhaust pipes 25. The exhaust pipes 25 terminate at a turbine stage exhaust gas inlet 26 for delivery to the turbine stage 14. Once the exhaust gases have passed through the turbine stage 14, they are discharged to the atmosphere in any suitable manner through the turbine stage gas outlet 27.

Figure 2:
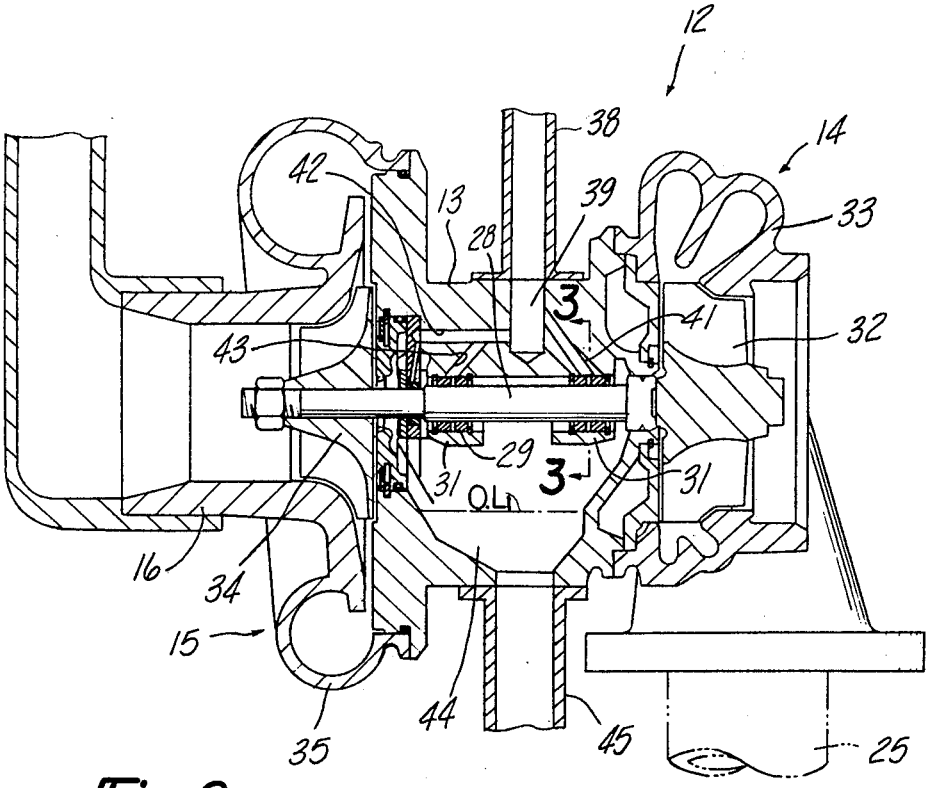
FIG. 2 is an enlarged, cross-sectional view showing the supercharger.

Referring primarily to FIG. 2 the supercharger 12 includes a main shaft 28 that is supported within the turbo-charger housing 13 by means of a pair of spaced, plain bearings 29 that are formed from a suitable bearing material as may be used for this type of application. The bearings 29 are of the full floating type and are positioned within bearing housings 31 of the main housing 13 in a known manner.

The turbine stage 14 includes an exhaust driven turbine 32 that is fixed to one end of the shaft 28 in a known manner and which is enclosed within a turbine casing 33 that is affixed in any known manner to the main casing 13. In a like manner, a compressor impeller 34 is affixed to the opposite end of the shaft 28 and runs in a compressor stage casing 35 that is also fixed in any known manner to the housing 13.

Referring again to FIG. 1, the engine 11 has a crankcase 36 in which an engine driven oil pump 37 is provided. The oil pump 37, in addition to providing pressurized lubriation for the components of the engine 11 in a known manner, delivers oil to a supercharger lubricating conduit 38 which may branch off of the main oil supply line or comprise a separate line from the pump outlet side. The conduit 38 delivers pressurized lubricant to the turbo-charger 12 through a lubricant inlet passage 39 formed in the turbo-charger main housing 13. The lubricant inlet 39 is cross-drilled as at 41, 42 and 43 to lubricate the running components of the turbo-charger 12 and specifically the bearings 29 and shaft 28.

The central portion of the main housing 13 is formed with a generally open area beneath the bearing housings 31 to define a oil sump 44. The oil which has been supplied with the lubricated components of the turbo-charger 12 will flow to the sump 44 and be returned to the engine crankcase 36 through an oil return line 45. A scavenge pump 46 is positioned within the crankcase 36 and is driven by the engine in any known manner so as to return the oil from the turbo-charger 12 to the crankcase 36.

Figure 3:
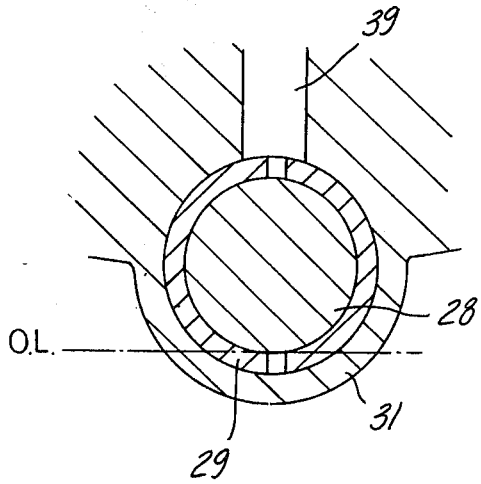
FIG. 3 is a cross-sectional view taken along the line 3—3 of FIG. 2.

The normal oil level in the crankcase 36 is indicated by the line OL and may be readily viewed through a sightglass 47. In accordance with this invention the turbo-charger 12 is located relative to the engine crankcase 36 and specifically to the oil level OL so that the lower portion of the bearings 29 will be at or slightly below the sump oil level OL. This is indicated in FIG. 3 where the oil level line OL has been inserted in relation to the bearings 29 and shaft 28. As will be noted, the relationship is such that the lower portion of the interface between the bearings 29 and the portion of the shaft 28 which they support will be positioned at or slightly below the normal oil level OL.

In operation, when the engine 11 is running, the exhaust gases pass through the exhaust pipes 25 and across the turbine impeller 32 and drive the shaft 28 and compressor impeller 34 to generate a boost for the intake air. Since the shaft 28 is position at or near the sump oil level OL, there is the likelihood that oil might be drawn into the turbine and compressor stages 14–15. The scavenge pump 46 is designed, however, in conjunction with the remaining components to maintain a normal oil level OLn in the turbo-charger sump 44 that is below the bearings 29. Thus, the problem of leakage of oil into the induction and exhaust systems when the engine is running are minimized. The pressurized oil supply provided to the bearings 29 will insure adequate lubrication as well as cooling.

When the engine 11 is stopped, however, the flow of pressurized oil from the oil pump 37 will obviously cease. However, in order to prevent overheating of the bearings 29, and specifically the oil that remains by the bearing surface of the shaft 28, oil will gradually be returned to the turbo-charger sump 44 past the scavenge pump 46 through the conduit 45 at a rate determined by the Torricellian theorem. Thus, the heating of the oil in the area between the bearings 29 and shaft 28 will be substantially minimized so as to avoid bearing damage when the engine 11 is next restarted.

Although it would be possible to provide a greater volume of oil in the turbo-charger sump 44, when the engine 11 is not running by providing a lower placement, such placement would either result in the turbo-charger 12 being positioned in an area where ground clearance would be significantly reduced and/or the turbo-charger might be exposed to damage, or alternately, the mounting level of the engine 11 would have to be increased so as to place the center of gravity too high. Thus, the positioning as described offers the advantages of being able to cool the bearings of the turbo-charger when the engine is not running without the defects discussed.

In the illustrated embodiment the turbo-charger 12 is lubricated by the same oil pump 37 for lubricating the engine. Of course, it would be possible to provide a separate lubricating pump for the turbo-charger 12. Various other changes and modifications may be made without departing from the spirit and scope of the invention, as defined by the appended claims.

We claim:

1. In a lubricating system for the supercharger of an internal combustion engine including a supercharger drive shaft supported by bearing means and a lubricating system including a sump for delivering oil to said bearing means when the engine is running, the improvement comprising means defining a generally open fluid conduit extending between said sump and said bearing means, said bearing means being positioned relative to the normal oil level in said sump so that said bearing mans are at or below said normal oil level for return of oil to said bearing means through said fluid conduit when the engine is stopped.

2. A lubricating system as set forth in claim 1 wherein the lubricating system includes a pump for drawing lubricant from the sump and delivering it under pressure to said bearing means.

3. A lubricating system as set forth in claim 2 wherein the sump comprises the crankcase of the engine.

4. A lubricating system as set forth in claim 1 wherein the supercharger sump for receiving oil from the bearing means and further including a scavenge pump for delivering oil from said supercharger sump to said sump.

5. A lubricating system as set forth in claim 4 wherein the lubricating system includes a pump for drawing lubricant from the sump and delivering it under pressure to said bearing means.

6. A lubricating system as set forth in claim 5 wherein the sump comprises the crankcase of the engine.

7. A lubricating system as set forth in claim 4 wherein the scavenge pump is positioned in the fluid conduit.

8. In a lubricating system for a supercharger of an internal combustion engine including a supercharger housing, a supercharger drive shaft, a pair of spaced bearings in said supercharger housing for rotatably supporting said supercharger drive shaft, an exhaust driven turbine affixed to one end of said drive shaft and adapted to receive exhaust gases from an associated engine for driving said supercharger drive shaft, a compressor affixed to the other end of said drive shaft for compressing an air charge for delivery to the induction system of the associated engine, said supercharger housing defining an oil sump beneath said bearings, the associated engine having a sump with a normal oil level therein, pump means for drawing oil from said engine sump for delivering to said supercharger bearings, conduit means extending from said supercharger sump to said engine oil sump, a scavenge pump in said conduit means for drawing oil from the supercharger oil sump and returning it to said engine oil sump to maintain an oil level in said supercharger oil sump lower than said bearings when the associated engine is running, the improvement comprising said supercharger bearings being positioned no higher than the normal oil level in said engine oil sump for return of lubricant thereto through said conduit means when the associated engine is not running.

* * * * *